US007483518B2

(12) United States Patent
Hamill

(10) Patent No.: US 7,483,518 B2
(45) Date of Patent: Jan. 27, 2009

(54) APPARATUS AND METHOD FOR RAPIDLY SWITCHING THE ENERGY SPECTRUM OF DIAGNOSTIC X-RAY BEAMS

(75) Inventor: James J. Hamill, Knoxville, TN (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 0 days.

(21) Appl. No.: 11/519,410

(22) Filed: Sep. 12, 2006

(65) Prior Publication Data

US 2008/0063145 A1 Mar. 13, 2008

(51) Int. Cl.
*H01J 35/10* (2006.01)
*H01J 35/00* (2006.01)
*G21K 3/00* (2006.01)

(52) U.S. Cl. ..... 378/144; 378/119; 378/158

(58) Field of Classification Search ..... 378/119, 378/121, 140, 142–145, 156–161
See application file for complete search history.

(56) References Cited

U.S. PATENT DOCUMENTS 4,300,055 A * 11/1981 Taumann ..... 378/158
4,399,550 A 8/1983 Hauck et al.
4,622,688 A 11/1986 Diemer et al.
4,646,339 A * 2/1987 Rice ..... 378/146
6,084,942 A * 7/2000 Hell et al. ..... 378/200
6,115,453 A 9/2000 Hell et al.
6,181,771 B1 1/2001 Hell et al.
6,269,147 B1 * 7/2001 Powell ..... 378/158
6,292,538 B1 9/2001 Hell et al.
6,735,273 B2 5/2004 Flohr et al.
2004/0247082 A1 12/2004 Hoffman

FOREIGN PATENT DOCUMENTS

DE 19819244 C1 * 9/1999

OTHER PUBLICATIONS

Peter Schardt, et al., New X-Ray Tube Performance in Computed Tomography . . . Medical Physics, vol. 31, No. 9, Sep. 2004, pp. 2699-2706.

* cited by examiner

*Primary Examiner*—Irakli Kiknadze
(74) *Attorney, Agent, or Firm*—Peter L. Kendall

(57) ABSTRACT

An X-ray imaging apparatus is disclosed. The apparatus includes a radiator housing, an X-ray tube, a source of X-rays and at least one filtration material disposed on the X-ray tube. The X-ray tube is rotatable about a longitudinal axis and is disposed at least partially within the radiator housing. The source of X-rays emits at least one X-ray beam at least partially through the X-ray tube. The X-ray beam exits the X-ray tube at an annular X-ray window. The filtration material at least partially covers a portion of the annular X-ray window. Rotation of the X-ray tube causes the X-ray beam to pass through a plurality of locations in the annular X-ray window and at least a portion of the X-ray beam is filtered by the filtration material.

15 Claims, 3 Drawing Sheets

APPARATUS AND METHOD FOR RAPIDLY SWITCHING THE ENERGY SPECTRUM OF DIAGNOSTIC X-RAY BEAMS

BACKGROUND

1. Field of the Disclosure

The present disclosure generally relates to X-ray apparatus, and more particularly to apparatus and methods for rapidly switching the energy spectrum of diagnostic X-ray beams.

2. Description of the Background Art

Diagnostic X-ray imaging and X-ray Computed Tomography (CT) are typically performed with X-rays generated by bombarding a metal plate, or anode, with electrons that have been accelerated across a potential difference, typically in the range from about 10 kilovolts to about 140 kilovolts, or kVp. The diagnostic image is formed when a patient is positioned between the X-ray source and an imaging device. In static imaging, the image is a map of the energy deposited by the X-rays while the patient and the device do not move. In CT, the image is made by a tomographic reconstruction of measurements acquired in many orientations of the X-ray source, which revolves around the patient while the patient bed is advanced or retracted.

X-rays emerge from their source with energies ranging from nearly 0 keV up to the full energy of the electron beam. Since the radiation of lowest energy is almost entirely absorbed in the patient, thus exposing the skin to ionizing radiation without helping to build the diagnostic image, the X-rays are typically filtered by placing an absorber material between the anode and the patient. That absorber is often called a filter. Other materials in the path of the X-rays also contribute to the filtration of the beam, for example the exit window of the X-ray tube and circumambient oil in the case of a rotating tube (e.g., the Straton tube, as disclosed in commonly-owned U.S. Pat. No. 6,084,942).

Many properties of the diagnostic image are characterized by the energy content of the X-rays. This is determined mainly by the kVp setting and the type of filtration. When one can make two or more X-ray images in rapid succession, with a different energy spectrum in each case, additional information is acquired. In angiography, this arrangement allows the physician to visualize vessels filled with an X-ray contrast medium. In CT, the information provided by multiple-energy imaging allows a better discrimination between such contrast media and human bone tissue, which may be useful in the case of Positron Emission Tomography (PET)/CT, where attenuation maps are derived from the CT images.

In the case of PET/CT and also Single Photon Emission Computed Tomography (SPECT)/CT, a more accurate PET or SPECT attenuation correction is realized when the amount of contrast material in soft tissue, blood pool, and the gastrointestinal tract can be accurately determined. These applications provide the ability to distinguish bone from contrast material.

SUMMARY

Apparatus and methods for rapidly switching the energy spectrum of diagnostic X-ray beams are disclosed.

According to one embodiment, an X-ray imaging apparatus is disclosed. The apparatus includes a radiator housing, an X-ray tube, a source of X-rays and at least one filtration material disposed on the X-ray tube. The X-ray tube is rotatable about a longitudinal axis and is disposed at least partially within the radiator housing. The source of diagnostic X-rays emits at least one X-ray beam at least partially through the X-ray tube and exits the X-ray tube at an annular X-ray window. The filtration material at least partially covers a portion of the annular X-ray window and may be disposed in a plurality of spaced-apart locations on the X-ray tube. Rotation of the X-ray tube causes the X-ray beam to pass through a plurality of locations in the annular X-ray window and at least a portion of the X-ray beam is filtered by the filtration material.

The X-ray tube includes an interior surface and an exterior surface. In an embodiment, the filtration material is disposed on the interior surface and/or on the exterior surface.

In various embodiments of the present disclosure, the filtration material is essentially made of uranium or thorium. Further, embodiments of the disclosure include a first filtration material and a second filtration material being disposed in an alternating orientation at least partially covering the annular X-ray window. In an embodiment, the first filtration material has a K-shell electron binding energy outside the range of about 30 keV to about 120 keV, and the second filtration material has a binding energy within that range.

In an embodiment, the first filtration material is aluminum with a thickness between about 5 mm and about 7 mm, for example, and the second filtration material is uranium with a thickness in the range of about 40 μm to about 60 μm, for example.

In an embodiment, the X-ray tube includes a voltage setting in the range of about 40 kilovolts and 160 kilovolts. In a further embodiment, the radiator housing is at least partially filled with a coolant.

The present disclosure also relates to a method for rapidly switching the energy spectrum of X-ray beams. An X-ray imaging apparatus is provided and the X-ray tube is rotated to cause the X-ray beam to pass through a plurality of locations in the annular X-ray window. Two types of filtration materials are used in an embodiment.

The present disclosure also relates to an X-ray filtration device including a source of X-rays and an actinide filtration material; such as uranium or thorium. The source of X-rays emits at least one X-ray beam which follows a path and the actinide filtration material is disposed at least partially in the path of the X-ray beam.

BRIEF DESCRIPTION OF THE DRAWINGS

The disclosure will become more clearly understood from the following detailed description in connection with the accompanying drawings, in which.

DETAILED DESCRIPTION

The following description is presented to enable one of ordinary skill in the art to make and use the disclosure and is provided in the context of a patent application and its requirements. Various modifications to the disclosed embodiments will be readily apparent to those skilled in the art and the generic principles herein may be applied to other embodiments. Thus, the present disclosure is not intended to be limited to the embodiment shown but is to be accorded the broadest scope consistent with the principles and features described herein.

Figure 1:
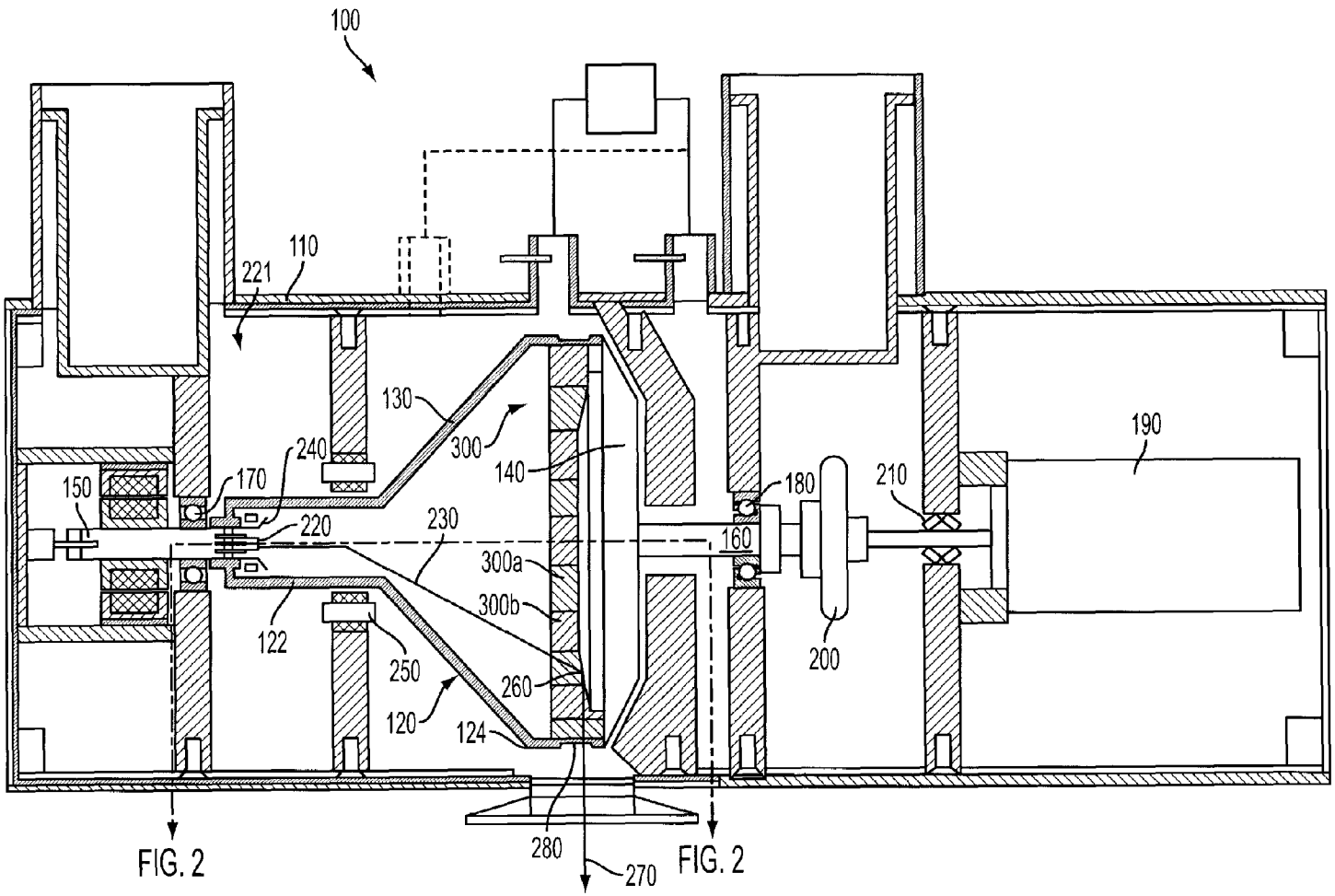
FIG. 1 is side sectional view of an X-ray imaging apparatus including a rotating bulb tube having a filtration material thereon according to an embodiment of the present disclosure.

Referring now to the drawings, and initially to FIG. 1, an X-ray apparatus, for example an X-ray tomography apparatus, in accordance with the present disclosure is shown and is generally referenced by numeral 100. In the illustrated embodiment, X-ray tomography apparatus 100 includes a radiator housing 110 and an X-ray tube 120 disposed therein. X-ray tube 120 includes a first portion 122 and a second portion 124 and is rotatable about longitudinal axis A-A extending therethrough. Here, X-ray tube 120 includes a vacuum housing 130 with a rotating anode 140 rigidly connected thereto. This embodiment also includes shaft stubs 150, 160 attached to vacuum housing 130 and to rotating anode 140, respectively. Further, X-ray tube 120 may include a voltage setting in the range of about 40 kilovolts to about 160 kilovolts. Additionally, X-ray tube 120 is illustrated seated in two bearings 170 and 180 and is in mechanical cooperation with a motor 190 and coupling 200 to facilitate rotation.

In the illustrated embodiment, the entire interior of radiator housing 110, except for the space accepting motor 190 and sealed by a suitable seal 210 and is filled with a fluid coolant 221, such as an electrically insulating oil.

As illustrated in FIG. 1, a source of electrons 220, such as a cathode, generates an electron beam 230. In an embodiment, a Wehnelt electrode 240 focuses electron beam 230. Here, electron beam 230 is deflected by an electromagnetic deflection system 250 enabling electron beam 230 to strike rotating anode 140, which rotates with X-ray tube 120, in a stationary point, namely a focal spot 260. X-ray beams 270 then emanate from focal spot 260 (e.g., source of X-ray beams 270). Only a central beam is illustrated in FIG. 1 for clarity. X-ray beams 270 emerge from X-ray tube 120 through vacuum housing 130 and exits radiator housing 110 through an annular X-ray window 280. Although not explicitly illustrated, the use of multiple focal spots is envisioned by this disclosure.

In use, X-ray tube 120 rotates along its longitudinal axis A-A. X-ray beams 270 are emitted through X-ray tube 120 and exits X-ray tube 120 through annular X-ray window 280. Annular X-ray window 280 is disposed around the periphery of X-ray tube 120 and allows X-ray beams 270 to pass therethrough.

Figure 2:
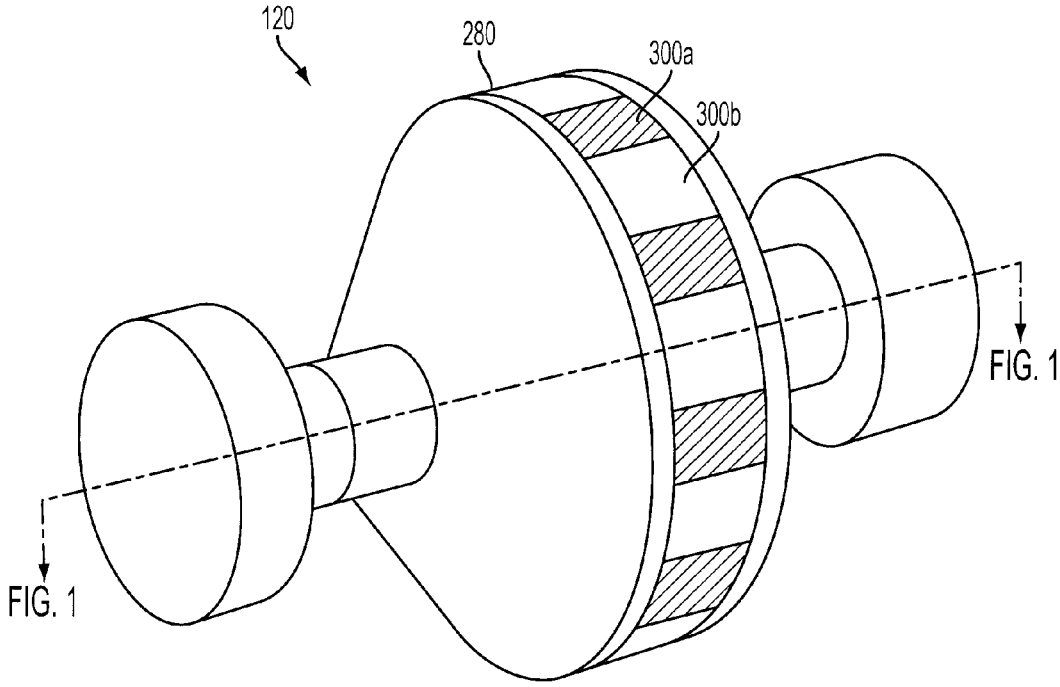
FIG. 2 is a perspective view of the rotating bulb tube of FIG. 1.
Figure 3A:
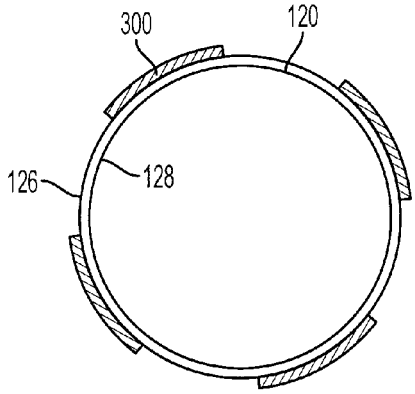
FIGS. 3A-3F illustrate cross sectional views of the rotating bulb tube of FIGS. 1 and 2 having filters variously oriented thereon.
Figure 3B:
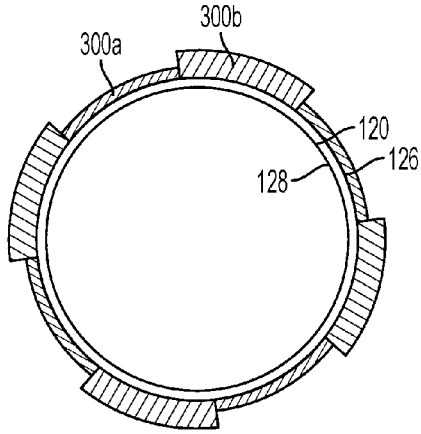
Figure 3C:
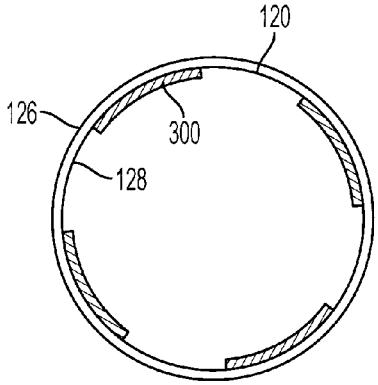
Figure 3D:
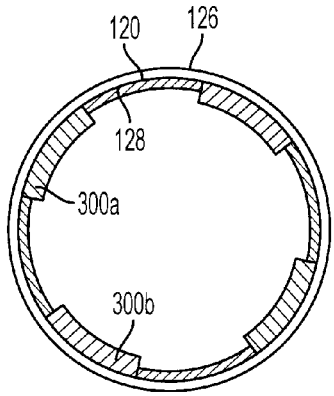
Figure 3E:
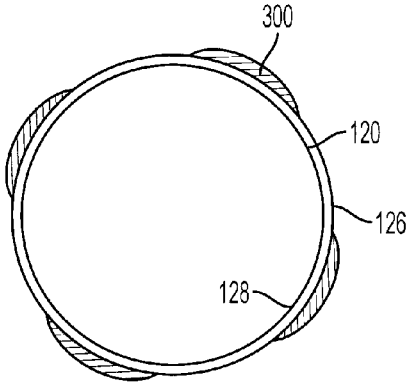

According to an embodiment of the present disclosure, at least one filtration material 300 is disposed on X-ray tube 120. Filtration material 300 at least partially covers a portion of annular X-ray window 280, thus filtering X-ray beams 270 as they pass therethrough. As illustrated in FIGS. 1-3, filtration material 300 is disposed in a plurality of spaced-apart locations on X-ray tube 120 and around its periphery. As illustrated in FIGS. 3A, 3C and 3E a first filtration material 300*a* is disposed on X-ray tube 120. Here, rotation of X-ray tube 120 causes X-ray beams 270 to be intermittently filtered by first filtration material 300*a* as it passes through X-ray tube 120. It shall be noted that in such an embodiment, the material of X-ray tube 120 (and/or annular X-ray window 280) may also act as a filter.

As shown in FIGS. 1, 2, 3B, 3D and 3F, a first filtration material 300*a* and a second filtration material 300*b* are included. Here, the filtration materials 300*a*, 300*b* (see FIG. 2) are an alternating orientation and are at least partially covering annular X-ray window 280. In such embodiments, as X-ray tube 120 rotates, X-ray beams 270 are filtered in an alternating fashion, thus rapidly switching the energy spectrum of X-ray beams 270. Such an embodiment may facilitate providing dual-energy imaging, which may be helpful, for example, in enhancing the ability to distinguish bone from contrast.

It is envisioned that first filtration material 300*a* strongly absorbs X-ray beams 270 whose energy is in the lower half of the spectrum, which extends from 0 to the tube's operating kVp. Second filtration material 300*b* absorbs the lower part of the spectrum more weakly, while reducing the combined X-ray intensity to approximately the intensity level provided by first filtration material 300*a*.

It is envisioned that first filtration material 300*a* is made from a material whose K-Shell electron binding energy is outside the range of about 30 keV to about 120 keV, such as aluminum. It is further envisioned that second filtration material 300*b* is made from a material whose binding energy is within the range of about 30 keV to about 120 keV, such as an actinide, including uranium or thorium.

With reference to FIGS. 3A-3F, X-ray tube 120 includes an exterior surface 126 and an interior surface 128. Filtration material 300 may be disposed on exterior surface 126 (FIGS. 3A, 3B and 3E), interior surface 128 (FIGS. 3C and 3D), or a combination of exterior surface 126 and interior surface 128 (FIG. 3F) of X-ray tube 120.

In an embodiment of the disclosure, filtration material 300 may be made of at least one material including aluminum, thorium, uranium, titanium, gold, lead, tungsten, tin, copper, iron, for example. Filtration material 300 may also be made of at least one rare-earth material including, for example, erbium, samarium or neodymium.

Figure 3F:
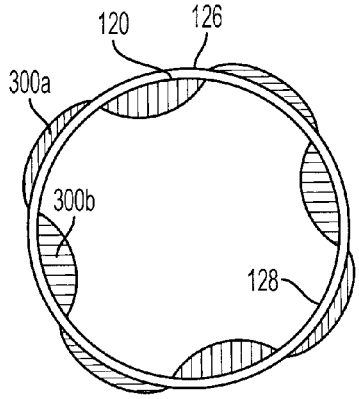

With reference to FIGS. 3A-3F, it is also envisioned that the thicknesses of filtration materials 300 may not be constant across their length and/or width (the thicknesses of the materials in FIGS. 3A-3F are not to scale). The thickness may be based on the material being used as filtration material 300 and on the amount of filtration desired. For example, it is contemplated that the thickness of first filtration material 300*a* is in the range of about 5 mm to about 7 mm, in the case of aluminum, and possibly equal to about 6 mm. Additionally, it is contemplated that the thickness of second filtration material 300*b* is in the range of about 40 μm to about 60 μm, in the case of uranium or thorium, and possibly equal about 50 μm. Further, as indicated by FIGS. 3E and 3F, the thickness of first filtration material 300*a* and/or second filtration material 300*b* may vary around the circumference of the tube.

It is envisioned that filtration materials 300 are removably attached to X-ray tube 120 to enable use for dual-energy imaging (when filtration materials 300 are attached to X-ray tube 120) and for normal operation (when filtration materials 300 are removed from X-ray tube 120).

The present disclosure also relates to a method for rapidly switching the energy spectrum of X-ray beams 270, for example, diagnostic X-ray beams. The method includes providing an X-ray tomography apparatus 100, such as that described above. The method further includes rotating X-ray tube 120 to cause X-ray beams 270 to pass through a plurality of locations in annular X-ray window 280.

Other applications for use of the X-ray apparatus 100 include various X-ray imaging devices. Such devices include CT scanners (including medical CT scanners) and medical X-ray imaging devices (also including medical CT scanners). Additionally, an embodiment of the apparatus and/or method disclosed in the present application may be used in angiography and in conjunction with baggage screening machines (e.g., in airports).

Although the present disclosure has been described in accordance with the embodiments shown, one of ordinary skill in the art will readily recognize that there could be variations to the embodiment and these variations would be within the spirit and scope of the present disclosure. Accordingly, many modifications may be made by one of ordinary skill in the art without departing from the spirit and scope of the appended claims.

What is claimed is:

1. An X-ray imaging apparatus, comprising:

a radiator housing;

an X-ray tube being rotatable about a longitudinal axis defined therethrough and being disposed at least partially within the radiator housing, the X-ray tube including a first portion and a second portion;

a source of X-ray beams which emits at least one X-ray beam at least partially through the X-ray tube and exiting the X-ray tube at an annular X-ray window peripherally disposed on the X-ray tube adjacent the second portion;

at least one filtration material disposed on the X-ray tube and at least partially covering a portion of the annular X-ray window, wherein the X-ray beam becomes filtered as it passes through the filtration material; and wherein rotation of the X-ray tube causes the X-ray beam to pass through a plurality of locations in the annular X-ray window and wherein at least a portion of the X-ray beam is filtered by the filtration material, wherein the X-ray imaging apparatus includes a first filtration material and a second filtration material, a plurality of the first filtration material and a plurality of the second filtration material being disposed in an alternating orientation at least partially covering the annular X-ray window.

2. The X-ray imaging apparatus of claim 1, wherein the at least one filtration material is disposed in a plurality of spaced-apart locations on the X-ray tube.

3. The X-ray imaging apparatus of claim 1, wherein the X-ray tube includes an interior surface and an exterior surface and wherein the at least one filtration material is disposed on an interior surface of the X-ray tube.

4. The X-ray imaging apparatus of claim 1, wherein the X-ray tube includes an interior surface and an exterior surface and wherein the at least one filtration material is disposed on an exterior surface of the X-ray tube.

5. The X-ray imaging apparatus of claim 1, wherein the at least one filtration material is essentially comprised of uranium.

6. The X-ray imaging apparatus of claim 1, wherein the at least one filtration material is essentially comprised of thorium.

7. The X-ray imaging apparatus of claim 1, wherein the first filtration material is made from a material whose K-Shell electron binding energy is outside the range of about 30 keV to about 120 keV and the second filtration material is made from a material whose K-Shell electron binding energy is within the range of about 30 keV to about 120 keV.

8. The X-ray imaging apparatus of claim 1, wherein the first filtration material is aluminum and the thickness is in the range of about 5 mm to about 7 mm.

9. The X-ray imaging apparatus of claim 8, wherein the second filtration material is uranium and the thickness is in the range of about 40 μm to about 60 μm.

10. The X-ray imaging apparatus of claim 1, wherein the X-ray tube includes a voltage setting in the range of about 40 kilovolts and 160 kilovolts.

11. The X-ray imaging apparatus of claim 1, wherein the radiator housing is at least partially filled with a coolant.

12. The X-ray imaging apparatus of claim 1 further defined as an X-ray Computed Tomography (CT) apparatus.

13. A method for rapidly switching the energy spectrum of X-ray beams, comprising:

providing an X-ray imaging apparatus, including:

a radiator housing;

an X-ray tube being rotatable about a longitudinal axis defined therethrough and being disposed at least partially within the radiator housing;

a source of X-ray beams which emits at least one X-ray beam at least partially through the X-ray tube and exiting the X-ray tube at an annular X-ray window peripherally disposed on the X-ray tube; and at least one filtration material disposed on the X-ray tube and at least partially covering a portion of the annular X-ray window; and rotating the X-ray tube to cause the X-ray beam to pass through a plurality of locations in the annular X-ray window, wherein the X-ray imaging apparatus includes a first filtration material and a second filtration material, a plurality of the first filtration material and a plurality of the second filtration material being disposed in an alternating orientation at least partially covering the annular X-ray window.

14. The method of claim 13, wherein the first filtration material is made from a material whose electron binding energy is outside the range of about 30 keV to about 120 keV and the second filtration material is made from a material whose electron binding energy is within the range of about 30 keV to about 120 keV.

15. The method of claim 13, wherein the at least one filtration material is essentially comprised of an actinide.

* * * * *